US005095660A

United States Patent [19]

Dillon

[11] Patent Number: 5,095,660

[45] Date of Patent: Mar. 17, 1992

[54] POLISHING MEANS FOR LENS GENERATING APPARATUS

[76] Inventor: Laurence A. Dillon, 11919 Globe, Livonia, Mich. 48150

[21] Appl. No.: 604,197

[22] Filed: Oct. 20, 1990

Related U.S. Application Data

[63] Continuation of Ser. No. 262,427, Oct. 25, 1988, abandoned.

[51] Int. Cl.[5] ..... B24B 13/00

[52] U.S. Cl. ..... 51/58; 51/284 R; 51/DIG. 34

[58] Field of Search ..... 51/58, DIG. 34, 400, 51/406, 407, 284 R, 283 R

[56] References Cited

U.S. PATENT DOCUMENTS

| | | | |
|---|---|---|---|
| 3,141,273 | 7/1964 | Sarofeen | 51/284 R |
| 4,274,232 | 6/1981 | Wylde | 51/DIG. 34 |
| 4,534,137 | 8/1985 | Sarofeen et al. | 51/284 R |
| 4,707,949 | 11/1987 | Hellström | 51/284 R |

FOREIGN PATENT DOCUMENTS

| | | | |
|---|---|---|---|
| 0074194 | 6/1977 | Japan | 51/401 |
| 8101533 | 6/1981 | PCT Int'l Appl. | 51/406 |

*Primary Examiner*—Robert A. Rose
*Attorney, Agent, or Firm*—Charles W. Chandler

[57] ABSTRACT

A cloth for polishing a prescription, plastic lens is mounted on a resilient pad having a curvature generally corresponding to that of the lens curvature. The polishing cloth clings to the pad during a vibratory polishing operation, performed with a liquid slurry. The pad is adhesively mounted on the conventional lap.

14 Claims, 2 Drawing Sheets

POLISHING MEANS FOR LENS GENERATING APPARATUS

This application is a continuation of application Ser. No. 262,427, filed 10/25/88, now abandoned.

BACKGROUND OF THE INVENTION

This invention is related to apparatus for polishing a prescription eyeglass lens formed of a plastic, such as polycarbonate or CR-39, and more particularly to a polishing pad having a felt-like cloth frictionally mounted on the pad, without the use of an adhesive.

Plastic lens blanks conventionally have a generated concave prescription surface. After the back surface has been generated, the lens is normally treated by abrasive pads in a finishing machine, and then polished in a final step. Both the prepolishing step and the polishing step are achieved in vibratory machines using adhesive paper-like pads, mounted in a lap to engage the lens surface while using a slurry. The lap has a convex curvature, generally corresponding to the concave curvature of the lens. Consequently, several laps are required in the labs inventory to accommodate the variety of lens curvatures.

The polishing pad is a thin, felt-like flexible element, having a series of slots which permit the polishing pad to be mounted on laps having different curvatures. The polishing pad is attached to the lap by an adhesive back. Each polishing pad is used to polish a single lens, then must be peeled from the lap and replaced for the next lens.

The removal and mounting of a conventional polishing pad is a time-consuming process, particularly in a laboratory where hundreds of lenses are processed each day. The required mounting and removal time is substantial. In fact, some workers have their time primarily devoted to mounting and peeling the polishing pads. Further, since the polishing pad is useful for only a single lens, a substantial inventory of polishing elements is necessary.

SUMMARY OF THE INVENTION

The broad purpose of the present invention is to improve the means for mounting a polishing pad on a lap for polishing an eyeglass lens. In the preferred embodiment, a resilient, urethane pad is adhesively attached to a lap in the position normally occupied by the conventional felt-like polishing pad. The urethane pad has an outer surface generally complementary to that of the lens surface. A polishing cloth is then mounted on the pad to cling to the urethane pad during the polishing operation.

The urethane pad has a long useful life. Further, the lap on which the conventional polishing pad is mounted, is a metal support having a curvature complementary to that of the lens. Since each lens has a different curvature, the lab has to have a large inventory of laps.

A compressible urethane pad, on the other hand, accommodates both a range of curvatures and slight variations in the lens curvature, because of its resiliency. In addition, the pad frictionally supports the polishing cloth.

The polishing cloth, which is a velvet or felt-like material, clings to the urethane pad without the use of an adhesive. This provides several advantages. One is that the polishing cloth can be used for as many as 25 lens polishing operations versus only one for a conventional polishing element. In addition, when the polishing cloth has to be replaced, the user can easily remove it from the urethane pad. The savings in time, expense and labor by using a polishing cloth in accordance with the present invention is substantial compared to the labor and time required for mounting and removing a conventional polishing element. The polishing cloth eliminates the use of all adhesive polishing pads.

Further, the use of a polishing cloth on a resilient urethane pad eliminates the need for pre-polish steps usually done by the use of one and sometimes two abrasive, adhesive pads.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
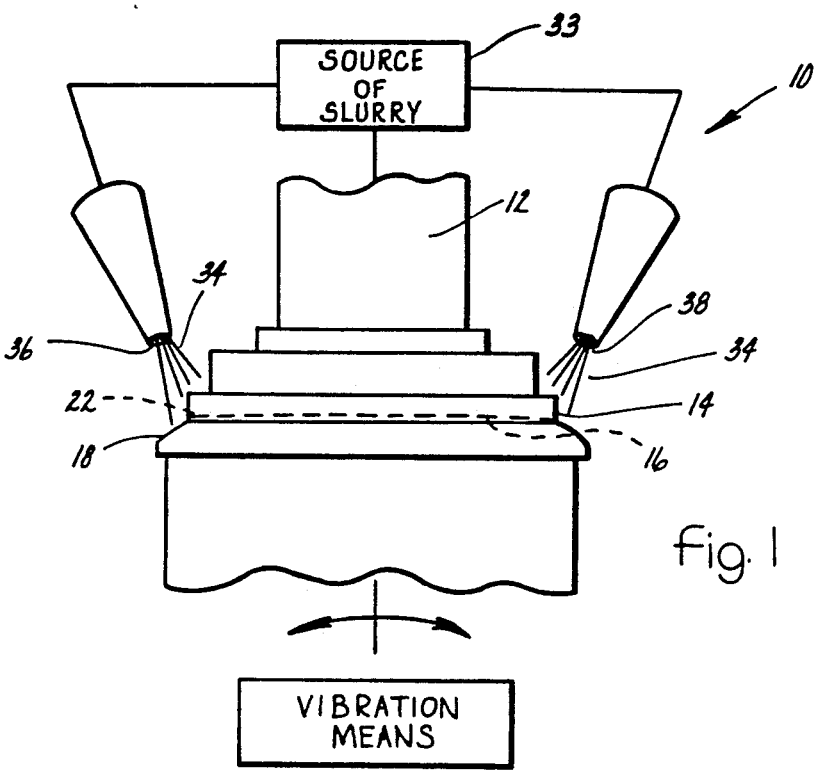
Fig. 1 PRIOR ART
FIG. 1 is a schematic illustration showing the vibratory means employed for polishing a lens.

FIG. 1 illustrates a conventional polishing apparatus, generally indicated at 10. Apparatus 10 comprises a block 12 supporting a lens blank 14 having a concave prescription surface 16 generated in the usual manner. A metal lap 18 is connected to vibration means 20 so as to move the lap in a vibratory motion generally parallel to lens surface 16. Lap 18 has a curvature 22 generally complementary to the curvature of the lens.

Figure 2:
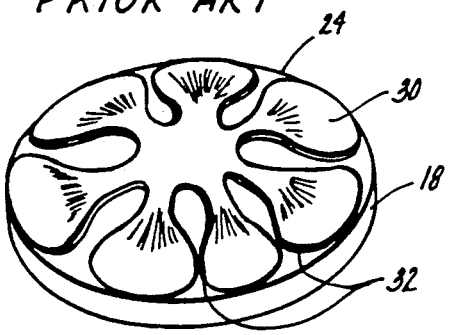
FIG. 2 is a view of a prior art polishing member mounted on a lap.

Referring to FIG. 2, lap 18, is illustrated removed from the polishing apparatus. A thin polishing element 24 is adhesively attached to the convex surface of the lap. The polishing element has a felt-like outer surface 30 which engages the lens. It also has a series of slots 32 so the normally flat element will seat on a convex surface.

During the polishing process, a pressurized source 33 delivers a liquid slurry 34 through a pair of nozzle means 36 and 38 mounted on opposite sides of the lens. The slurry and the polishing element cooperate to polish surface 16 of the lens.

Figure 3:
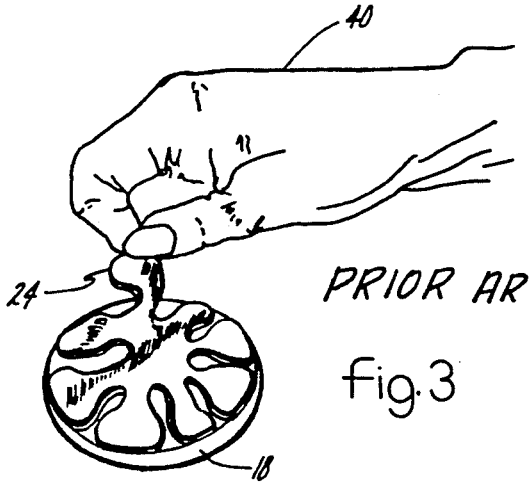
PRIOR ART Fig. 3
FIG. 3 is a view illustrating the manner in which a used prior art polishing element is peeled from the lap.

FIG. 3 illustrates the step required at the conclusion of each lens polishing operation. The user 40 must peel polishing element from lap 18 and then replace it with a new polishing element.

Figure 4:
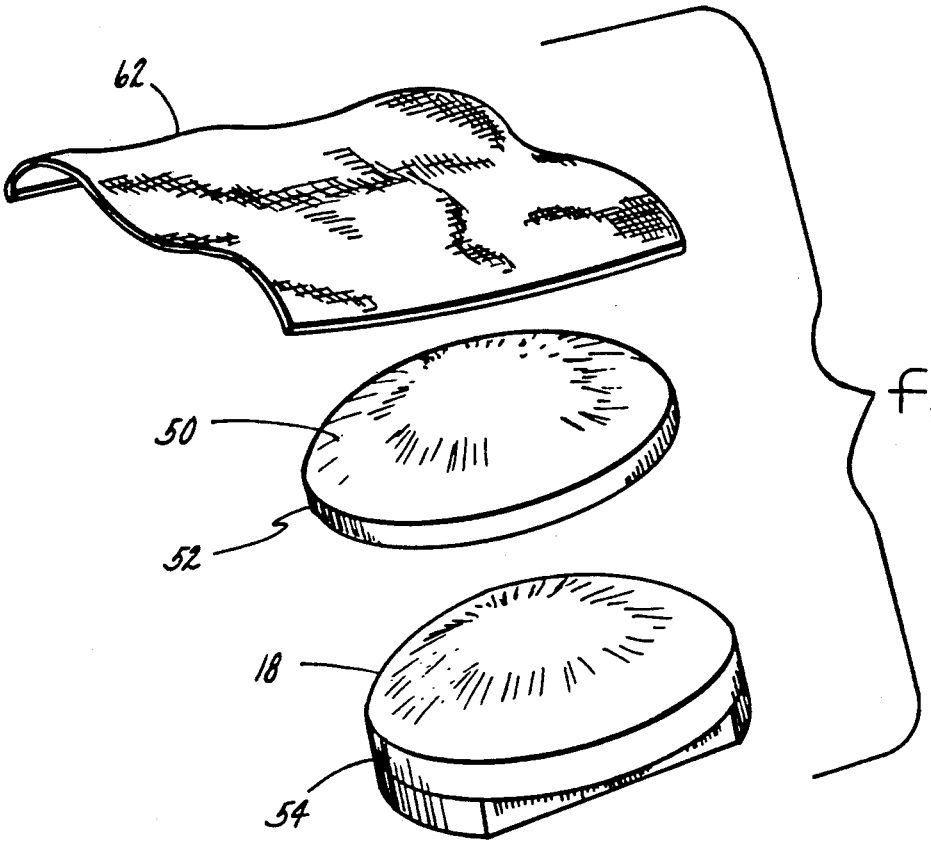
FIG. 4 is an exploded view of a polishing means illustrating the preferred embodiment of the invention.
Figure 5:
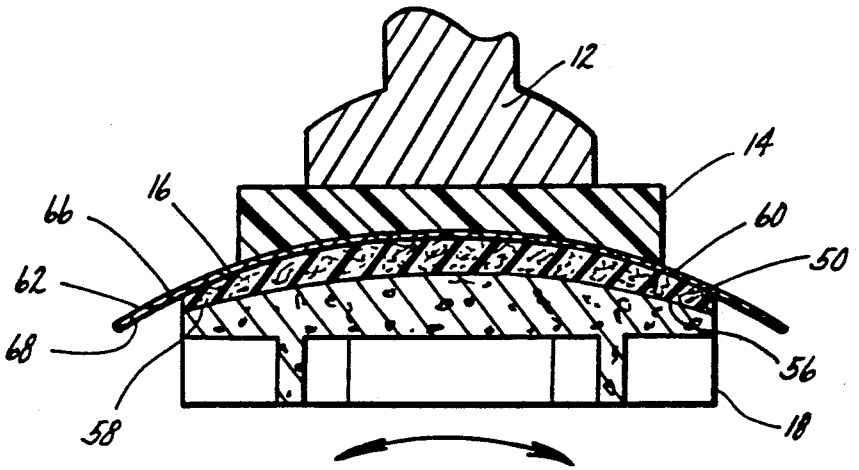
FIG. 5 is a sectional view showing the manner in which the polishing cloth engages the lens.

Referring to FIGS. 4 and 5, a compressible, resilient urethane pad 50 is illustrated. Pad 50 has a border 52 cut to generally match the border 54 of lap 18. The pad has a lower curved surface 56 generally accommodating the curvature 22 of the lap, and is attached by a releasable adhesive 58 to the lap. The pad has an outer curved surface 60 generally corresponding to the curvature of surface 16 of the lens. The pad is about 3/16 inch thick and is slightly compressible so that surface 60 will accommodate variations in the lens surface. A preferred pad material is available from the Plastomer Corp. of Livonia, Mich. and known as 291-HY urethane.

A felt polishing cloth 62, having a diameter greater than that of pad 50, is mounted on the outer concave surface of the pad. The polishing cloth has an upper surface 66 with a layer of a velvet-like material. The lower surface 68 has a somewhat smoother surface. A preferred cloth material is available from Detroit Fabrics Company, Catalog No. 87C-A-134. The lower fabric surface clings to the pad when the cloth is wet with liquid slurry 34.

The cloth can be either easily mounted on the pad or removed from the pad because there is no adhesive between the cloth and the pad. Further the cloth can be used for as many as 25 lens polishing operations. Pad 50 has a relatively unlimited life and will accommodate several lens curvatures.

Thus it is to be understood that I have described an improved means for polishing plastic eye glass lenses such as made of either polycarbonate or CR-39, the two more popular lens materials. The preferred polishing means provides substantial savings not only in reducing the labor in mounting and removing the polishing element from the mounting pad, but also in reducing the usual considerable inventory of the polishing materials.

Having described my invention, I claim:

1. A polishing means for polishing an optical lens, said lens having a curvature, comprising:

a lap;

a resilient, compressible pad made of a single material fixedly mounted on the lap and having a surface with a curvature generally compatible with that of the lens;

a flexible polishing cloth loosely mounted on the pad without any disparate material being fixed to the pad intermediate said pad and said cloth, such that said cloth clings to said pad by direct frictional contact when wetted with a liquid slurry, the cloth being engageable with the lens; and means for imparting relative polishing motion between the lap and the lens.

2. A polishing means as described in claim 1, in which the lap has a curvature compatible with the curvature of the lens.

3. A polishing means as defined in claim 1, in which the lens has a first diameter and the resilient pad has a diameter larger than the first diameter of the lens.

4. A polishing means as defined in claim 1, including adhesive means for releasably attaching the pad to the lap.

5. A polishing means as defined in claim 1, in which the polishing cloth is made of felt.

6. A polishing means as defined in claim 5, in which the polishing cloth has an upper surface with a layer of velvet-like material and a somewhat smoother lower surface.

7. A polishing means as defined in claim 6, in which the resilient pad is made of urethane.

8. A polishing means as in claim 7, including a liquid slurry applied to the lens.

9. A polishing means as defined in claim 8, in which the polishing cloth is devoid of slots.

10. A polishing means as defined in claim 5, in which the polishing cloth is devoid of slots.

11. A polishing means as defined in claim 10, in which the resilient pad is made of urethane.

12. A polishing means as in claim 11, including a liquid slurry applied to the lens.

13. A polishing means as defined in claim 5, in which the resilient pad is made of urethane.

14. A polishing means as in claim 13, including a liquid slurry applied to the lens.

* * * * *